United States Patent [19]

Hori

[11] Patent Number: 4,815,873

[45] Date of Patent: Mar. 28, 1989

[54] INITIALIZING METHOD FOR PRINTING TYPE RINGS IN PRINTER

[75] Inventor: Fumihisa Hori, Takizawa, Japan

[73] Assignee: Alps Electric Co., Ltd, Japan

[21] Appl. No.: 82,857

[22] Filed: Aug. 6, 1987

[30] Foreign Application Priority Data

Sep. 30, 1986 [JP] Japan ..... 61-230151

[51] Int. Cl.[4] ..... B41J 7/76

[52] U.S. Cl. ..... 400/154.4; 250/231 SE; 101/93.21; 400/162.3

[58] Field of Search ..... 400/154–154.4, 400/162.3, 163, 144.2; 101/93.21, 93.18; 250/231 SE, 237 G, 247 P

[56] References Cited

U.S. PATENT DOCUMENTS

| | | | |
|---|---|---|---|
| 3,187,187 | 6/1965 | Wingate | 250/231 SE |
| 3,472,352 | 10/1969 | Kondur, Jr. | 400/154.4 |
| 3,651,914 | 3/1972 | Locke | 400/154.4 |
| 3,757,922 | 9/1973 | Sweeney | 400/154.4 |
| 3,985,448 | 10/1976 | Wiklund et al. | 250/237 G |
| 4,019,110 | 4/1977 | Gerry | 400/144.2 |
| 4,111,117 | 9/1978 | Tezuka et al. | 101/93.28 |
| 4,352,576 | 10/1982 | Hori et al. | 400/154.4 |
| 4,421,980 | 12/1983 | Kuhne | 250/231 SE |
| 4,541,746 | 9/1985 | Bobart et al. | 400/154.4 |

*Primary Examiner*—William Pieprz

*Attorney, Agent, or Firm*—Guy W. Shoup; Paul J. Winters; Nathan N. Kallman

[57] ABSTRACT

Disclosed is herein an initializing method for printing type rings in a printer having printing type rings, a sensor disc and a detector portion which constitutes a plurality of main detecting portions and an end detecting portion, the printing type rings being stopped in predetemined positions with pulses provided from the sensor upon opposition of the main detecting portions of the sensor disc to the sensor, followed by printing, characterized in that plural pulses provided from the sensor upon rotation of the sensor disc are counted to determine a minimum pulse interval and the pulse counted just after the omission of pulse counting for a period larger than the minimum pulse interval and smaller than the interval between the main detecting portion located at the terminal end and the end detecting portion is judged to be a pulse provided by the end detecting portion opposedly to the sensor, whereupon the printing type rings and the sensor disc are stopped.

5 Claims, 1 Drawing Sheet

INITIALIZING METHOD FOR PRINTING TYPE RINGS IN PRINTER

BACKGROUND OF THE INVENTION

1. Field of the Invention

The present invention relates to an initializing method for printing type rings in a printer for positioning the printing type rings with plural printing types formed on the outer peripheral surface thereof, in predetermined positions and starting the operation of the printer.

2. Description of the Prior Art

Generally, in printers using printing type rings, the printing type rings are disposed to permit rotation only in one direction and a sensor disc having a detector portion is disposed coaxially with the printing type rings, with a pulse provided from a sensor upon opposition of the detector portion to the sensor, the detector portion including a printing type position detecting portion composed of plural main detecting portions arranged at equal intervals in the circumferential direction and corresponding to the printing types, and also including a detecting portion for producing an end pulse indicative of an end of operation of the printer (a current supply interrupting timing for a motor). The main detecting portions of the sensor disc are each brought into opposition to the sensor, and with pulses thereby provided from the sensor the printing type rings are stopped in predetermined positions and printing is performed, then the operation of the printer is terminated (the current supply to the motor is cut off) with a pulse provided from the end pulse generating detecting portion.

For effecting initialization in the above printer it is necessary to provide the end pulse generating detecting portion which is independent of the main detecting portions for the detection of printing type positions. Therefore, the mechanism is complicated and as many as two expensive detectors must be used.

SUMMARY OF THE INVENTION

The present invention has been accomplished in view of the above-mentioned points and it is the object thereof to provide an initializing method for printing type rings in a printer, capable of positioning the printing type rings in predetermined positions and effecting accurate printing.

According to the present invention, in a printer having printing type rings disposed rotatably in one direction and with plural printing types formed on the outer peripheral surface thereof, and a sensor disc disposed rotatably in one direction in synchronism with the printing type rings and having a detector portion adapted to become opposed to a sensor which produces a pulse in response thereto, the said detector portion comprising a plurality of main detecting portions arranged at equal intervals and corresponding to the printing types, and an end detecting portion for the detection of an initial position, the end detecting portion being spaced from the main detecting portion located at the terminal end by a distance twice or more the spacing between the main detecting portions and spaced from the main detecting portion located at the fore end by a distance almost equal to the spacing between the main detecting portions, the printing type rings being stopped in predetermined positions with pulses provided from the sensor upon opposition of the main detecting portions of the sensor disc to the sensor, followed by printing, the present invention is characterized in that plural pulses provided from the sensor upon rotation of the sensor disc are counted to determine a minimum pulse interval and the pulse counted just after the omission of pulse counting for a period larger than the said minimum pulse interval and smaller than the interval between the main detecting portion located at the terminal end and the end detecting portion is judged to be a pulse provided by the end detecting portion opposedly to the sensor, whereupon the printing type rings and the sensor disc are stopped.

Thus, first a plurality of pulses are counted to determine a minimum pulse interval or the spacing between main detecting portions, then that the main detecting portions have gone is confirmed by a failure to count pulse for a period larger than the said minimum pulse interval and smaller than the spacing between the main detecting portion at the terminal end and the end detecting portion, and the pulse counted just thereafter is judged to be a pulse provided by the end detecting portion opposedly to the sensor, and thereafter the printing type rings and the sensor disc are stopped in their initial positions, thereby initializing the printing type rings.

DESCRIPTION OF A PREFERRED EMBODIMENT

An embodiment of the present invention will be described hereinunder with reference to the accompanying drawing.

Figure 2:
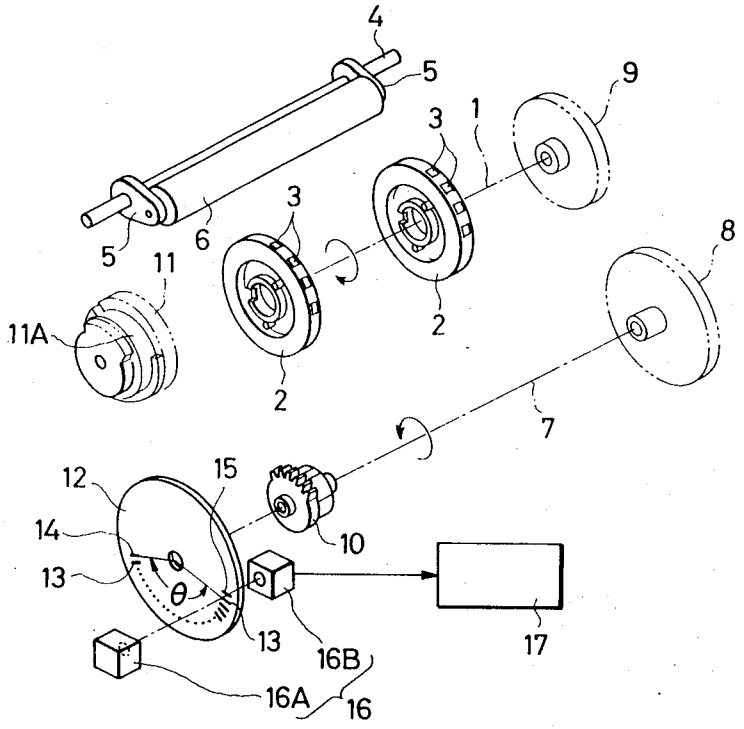
FIG. 2 is a schematic perspective view of a printer for practising the method shown in FIG. 1.
Figure 1:
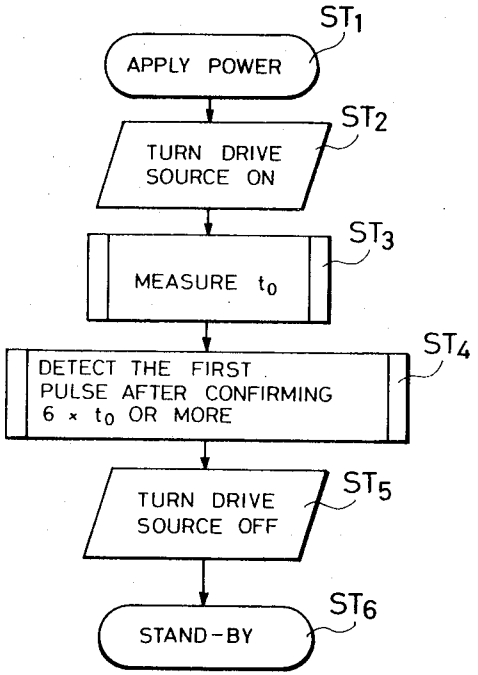
FIG. 1 is a flow chart showing an initializing method for printing type rings in a printer according to an embodiment of the present invention.

FIG. 2 schematically illustrates a printer used for practising the initializing method for printing type rings according to the present invention, in which, for example, eighteen sets of printing type rings 2 for printing types such as 18-digit characters, numeral or symbols are fitted on a printing type ring shaft 1 axially in parallel. The printing type rings 2 are generally disc-like and are formed with, say, twelve printing types 3 on the outer peripheral surface thereof. In front of the printing type ring shaft 1 is disposed a hammer shaft 4 which is parallel to the shaft 10, and a pair of spaced brackets 5 are mounted on the hammer shaft 4 projectingly in the same circumferential direction, with an elongated round bar-like hammer 6 being supported by both brackets 5 therebetween. As the hammer shaft 4 rotates in the direction of arrow, the hammer 6 comes into pressure contact with the printing type rings 2 to print the printing types 3 on the rings 2 opposed to the hammer 6, onto paper (not shown) which is held between the hammer 6 and the printing type rings 2.

Behind the printing type ring shaft 1 is disposed, in parallel therewith, a cam shaft 7 having a cam for controlling a selecting pawl (not shown) to lock each printing type ring 2 in an opposed state of a desired printing type 3 to the hammer 6. Transfer gears 8 and 9 meshing with each other are fitted on end portions of the cam shaft 7 and the printing type ring shaft 1, respectively. Further, another transfer gear 10 is fitted on the cam shaft 7, and an intermittent gear 11 connected to a drive source (not shown) is in mesh with the transfer gear 10, so that the cam shaft 7 is rotated in the direction of arrow. The rotation of the cam shaft 7 is transferred to the printing type ring shaft 1 by means of both transfer gears 8 and 9, whereby the shaft 1 is rotated twice in the direction of arrow for each rotation of the cam shaft 7. That the printing type ring shaft 1 rotates twice in a single printing is for setting a desired printing type 3 on each printing type ring 2 at the first single rotation and initializing each ring 2 after printing at the next single rotation.

On an end portion of the cam shaft 7 opposite to the end portion where the transfer gear 8 is mounted, there is fitted a sensor disc 12 for integral rotation with the cam shaft 7. Along the outer peripheral edge portion of the sensor disc 12 are formed twenty-four, as the total number of the printing types 3 on both printing type rings 2, of slits 13 which serve as main detecting portions, circumferentially at equal intervals. Further, a slit 14 also serving as a main detecting portion is formed in a position adjacent to the slit 13 at the trailing end of the array of slits in the rotational direction of the sensor disc 12 at an interval equal to the spacing between slits 13. The angle $\theta$ between the slit 13 at the fore end and the slit 14 is set at about 130 degrees. Still in front of the slit 13 at the leading end in the rotational direction of the sensor disc 12 there is formed an initial position detecting slit 15 at a distance almost equal to the spacing between slits 13. Thus, the slit 15 is spaced from the slit 14 in the area not occupied by slits 13 at a large angle not smaller than 180 degrees. On the other hand, on both sides of the sensor disc 12 are disposed a light emitting element 16A and a light sensing element 16B of a photosensor 16 as an example of the sensor. The light emitting element 16A emits light in the direction of the sensor disc 12. This emitted light from the light emitting element 16A passes through each of the slits 13, 14 and 15 upon opposition of these slits to the light emitting element 16A and reaches the light sensing element 16B, which in turn produces pulses. The pulses from the light sensing element are fed to a controller 17 which provides various controls for the printer. The intermittent gear 11 is formed with a smooth portion 11A for disengaging the gear 11 from the transfer gear 10 in a state in which the light from the light emitting element 16A passes through the initial position detecting slit 15 at the end of the printing operation, and also for engagement with the angle transfer gear 10 at the time of start of the printing operation.

The following description is now provided about the method of the present invention on the basis of the above construction as an embodiment of the invention.

First, power is applied in step $ST_1$ to start operation of the printer. In this state it is not clear in what position the stationary printing type rings 2 and the sensor disc 12 are. Therefore, initialization is performed to avoid misprinting and a drive source such as a motor (not shown) is turned ON to rotate the cam shaft 7 as shown in step $ST_2$. This rotation is transferred to the cam shaft 7 through the intermittent gear 11 and the transfer gear 10, and the printing type ring shaft 1 connected with the cam shaft 7 through the transfer gears 8 and 9 is also rotated synchronously. Then, with the rotation of the sensor disc 12, the light emitted from the light emitting element 16A of the photosensor 16 toward the sensor disc 12 passes through the slits 13, 14 and 15 and reaches the light sensing element 16B, and ten pulses generated at this moment are applied to the controller 17 successively from the light sensing element 16B, whereupon the controller 17 counts those ten pulses and measures a minimum pulse interval ($t_0$) out of nine pulse intervals defined by the ten pulses (step $ST_3$). This minimum pulse interval ($t_0$) is the very pulse interval defined by the passage of slits 13 and 14 relative to the photosensor. Then, as shown in step $ST_4$, it is confirmed that the pulse interval of pulses provided from the light sensing element 16B following the above ten pulses became six times ($6 \times t_0$) or more as large as the minimum pulse interval ($t_0$), and the pulse provided just thereafter from the light sensing element 16B to the controller 17 is judged to be a pulse formed through the slit 15, so the initialization is completed and the drive source turned OFF (step $ST_5$). The printer is now in a stand-by condition for actual printing operation (step $ST_6$). The smooth portion 11A of the intermittent gear 11 is opposed to the transfer gear 10 in an opposed state of the slit 15 to the light emitting element 16A, so even if the intermittent gear 11 rotates at a certain angle by virtue of inertia at the time of turning OFF the drive source in accordance with a stop pulse provided from the light sensing element 16B upon opposition of the slit 15 to the light emitting element 16A, the rotation of the gear 11 is not transmitted to the cam shaft 7, so that the sensor disc 12 on the cam shaft 7 and the printing type rings 2 on the printing type ring shaft 1 can maintain their normal initial positions. At this time, a long pulse is provided from the light sensing element 16B through the slit 15 which is at a standstill.

In the actual printing operation, when a pulse is provided from the light sensing element 16B upon opposition of the slit 13 corresponding to a preset numeral for example to the light emitting element 16A of the photosensor 16, a solenoid (not shown) is energized and the rotation of the printing type 3 of the preset numeral is restrained by the action of a selecting pawl (not shown) in the position where the printing type 3 is opposed to the hammer 6. Then, as soon as a pulse formed through the slit 13 which follows the above corresponding slit 13 is output from the light sensing element 16B, the solenoid is deenergized. The slit 14 is for deenergizing the solenoid which has been energized by the trailing end slit 13.

When predetermined printing types 3 on the printing type rings 2 are opposed to the hammer 6, the hammer shaft 4 is rotated once to bring the hammer 6 into pressure contact with the printing types 3 on the printing type rings 2 to make printing onto paper (not shown) held between the printing type rings 2 and the hammer 6.

According to the above embodiment, the printing type rings 2 and the sensor disc 12 can be initialized by detecting the initial position detecting slit 15 accurately, thus permitting accurate printing at the time of the next printing no matter in what state the printing type rings 2 and the sensor disc 12 may stop. In the above embodiment, moreover, since the sensor disc 12 is mounted on the cam shaft 7 and the cam shaft 7 rotates only once in a single printing, so there is generated no wasteful pulse unlike the conventional construction in which the sensor disc 12 is mounted on the printing type ring shaft 1 and therefore the second unnecessary pulse must be ignored or cut off.

Although in the above embodiment the detecting portion of the sensor disc 12 has been explained as slits 13, 14 and 15, there may be adopted a construction in which the detecting portion comprises projections and the light from the light emitting element 16A is shielded by the projections to generate pulses. Further, the sensor is not limited to the photosensor 16, nor is the present invention limited to the above embodiment.

According to the present invention, as set forth hereinabove, it is possible to effect initialization stably to position printing type rings in predetermined rotational positions at the time of start-up of the printer, thereby ensuring accurate printing.

What is claimed is:

1. A method for operating a printer having printing type rings mounted to a first shaft for rotation in a first direction;

a sensor disk mounted to a second shaft for rotation in a second direction opposite to said first direction;

transfer gear means for coupling said first and second shafts for simultaneous rotation in opposite directions;

hammer means for contacting said printing type rings and for effectuating printing of print types onto a paper;

said sensor disk having formed thereon a series of detecting elements disposed over a first sector of said disk, said sector with said detecting elements defining an angle substantially less than 180°, said series of elements including a leading detecting element at the beginning of said series in the second direction, said leading element operative as an initial position detecting element, a trailing element at the end of said series in the second direction of rotation and a multiplicity of at least ten main detecting elements intermediate said leading element and trailing element, the remaining second sector between said trailing element and leading element having a space with no detecting elements and defining an angle of at least 180°; said main detecting elements being equally spaced and corresponding in number to the number of printing types; said trailing detecting element being spaced from the last main detecting element in the second direction of rotation at a distant approximately two times that of the distance between adjacent main detecting elements;

sensing means for detecting the passage of said detecting elements during rotation of said sensor disk and for generating a pulse signal in response to the passage of each element;

characterized by the steps of continuously counting the number of pulses generated during the rotation of said sensor disk; measuring a minimum pulse interval between said pulses; further rotating said disc to generate pulses from said sensing means; determining that a pulse interval between said generated pulses is not greater than a value twice or more than said minimum pulse interval; establishing that said generated pulse signal after said determining step is a stop pulse produced in response to said trailing element, stopping said printing type rings at a predetermined position in response to said stop pulse.

2. An initializing method according to claim 1, wherein said are formed by slits.

3. An initializing method according to claim 1, wherein said series of elements are formed by projections.

4. An initializing method according to claim 1, wherein said sensing means is a photosensor.

5. An initializing method according to claim 4, wherein said photosensor comprises a light emitting element and a light sensing element which are disposed on both sides of said sensor disc.

* * * * *

UNITED STATES PATENT AND TRADEMARK OFFICE

CERTIFICATE OF CORRECTION

PATENT NO. : 4,815,873

DATED : March 28, 1989

INVENTOR(S) : Fumihisa Hori

It is certified that error appears in the above-identified patent and that said Letters Patent is hereby corrected as shown below:

Claim 2, Col. 6, line 26, insert after "said", --series of elements--.

Signed and Sealed this

Twenty-eighth Day of November 1989

*Attest:*

JEFFREY M. SAMUELS

*Attesting Officer* *Acting Commissioner of Patents and Trademarks*